US005406304A

United States Patent [19]

Shirayama

[11] Patent Number: 5,406,304

[45] Date of Patent: Apr. 11, 1995

[54] FULL COLOR LIQUID CRYSTAL DRIVER

[75] Inventor: Iwao Shirayama, Tokyo, Japan

[73] Assignee: NEC Corporation, Tokyo, Japan

[21] Appl. No.: 261,039

[22] Filed: Jun. 14, 1994

Related U.S. Application Data

[63] Continuation of Ser. No. 936,284, Aug. 28, 1991, abandoned.

[30] Foreign Application Priority Data

Aug. 28, 1991 [JP] Japan ..... 3-242800

[51] Int. Cl.[6] ..... G09G 3/36

[52] U.S. Cl. ..... 345/98; 345/196

[58] Field of Search ..... 345/98, 100, 97, 87, 345/99, 103, 196, 197, 200; 348/790, 791

[56] References Cited

U.S. PATENT DOCUMENTS

| | | | |
|---|---|---|---|
| 4,799,057 | 1/1989 | Takeda et al. | 340/811 |
| 4,859,998 | 8/1989 | Kawamura et al. | 345/98 |
| 5,157,386 | 10/1992 | Uchida et al. | 340/793 |
| 5,170,155 | 12/1992 | Plus et al. | 340/805 |
| 5,170,158 | 12/1992 | Shinya | 345/98 |

OTHER PUBLICATIONS

"4.3 inch Full Color LCD Module", Osamu Suegawa et al, Technical Report Vol. 41, No.5/1988.

*Primary Examiner*—Jeffery A. Brier
*Assistant Examiner*—A. Au
*Attorney, Agent, or Firm*—Sughrue, Mion, Zinn, Macpeak & Seas

[57] ABSTRACT

A full color liquid crystal driver which includes a line memory for dividing an input video signal for each horizontal scan period into n groups and expanding each divided signal to n folds, n amplifiers for amplifying the output signals of the line memory to be voltages necessary to drive a liquid crystal display element, and n signal output circuits. Given that the number of horizontal pixels of the liquid crystal display element is x and the horizontal scan period is t, the necessary operation frequency for the amplifiers and signal output circuits becomes 1/(n(t/x)), which is lower by 1/n than the operation frequency necessary for the amplifiers and signal output circuits of prior art. In the case where the number of horizontal pixels is significantly increased in a conventional active matrix type liquid crystal display element, providing full color display requires very-fast amplifiers and very-fast signal output circuits for applying a voltage to the liquid crystal display element. The present invention can still use amplifiers and signal output circuits both functioning at the normal speed to easily drive a liquid crystal display element having a vast number of horizontal scan period.

3 Claims, 7 Drawing Sheets

FULL COLOR LIQUID CRYSTAL DRIVER

This is a Continuation of application Ser. No. 07/936,284, filed, Aug. 28, 1991, now abandoned.

BACKGROUND OF THE INVENTION

The present invention relates to a full color liquid crystal driver, and, more particularly, to a full color liquid crystal driver which drives an active matrix type liquid crystal element.

FIG. 1 is an equivalent circuit diagram illustrating a full color liquid crystal display (hereinafter referred to as "LCD") of an active matrix type (see NEC, Technical Report Vol. 41 No. 5/1988). Liquid crystal pixels 21 are arranged in a matrix form, each pixels 21 connected to an amorphous silicon TFT (Thin Film Transistor) 22. Connected to those liquid crystal pixels 21 and TFTs 22 are a signal supplying circuit 23 and a scan circuit 24. In this active matrix type LCD, at the time the signal of each pixel 21 is selected, the scan circuit 24 turns the TFT 22 corresponding to that pixel 21 on to write a signal voltage in the pixel 21. During the other time, the scan circuit 24 turns that TFT 22 off to prevent the crosstalk between the adjoining pixels while holding the signal voltage in that pixel 21. In this driving system, only a signal voltage is always applied to the liquid crystal pixels, thus ensuring high-quality display.

FIG. 2 presents a block diagram illustrating a conventional full color liquid crystal driver that drives this active matrix type liquid crystal display element.

When an analog video signal in a horizontal scan period t is input from a video signal input terminal 5, an amplifier 2 amplifies this video signal to be a voltage necessary to drive a liquid crystal display (LCD) element 4 which consists of x horizontal pixels. Thus the amplifier 2 has an operation frequency of 1/(t/x). A signal output circuit 3 has a sample/hold circuit, which samples the output signal of the amplifier 2 in accordance with the individual horizontal pixels of the LCD element 4, and an output buffer, and outputs a signal at an operation frequency of 1/(t/x). This signal output circuit 3 divides the received video signal into x signals which are equal in number to the horizontal pixels of the LCD element 4 and outputs the divided signals to the LCD element 4.

According to this conventional full color liquid crystal driver, however, to provide full color display (analog display) when the number of horizontal pixels of the LCD element is increased, the frequency response of the analog amplifier 2 should be improved. In other words, the driver needs to operate at a significantly high speed, thus requiring that the amplifier 2 and the signal output circuit 3 function very fast. Due to the limited operation frequency of the amplifier 2 and the signal output circuit 3, typically used, the conventional driver has a difficulty in driving an LCD element that has a vast amount of pixels. If the amplifier 2 and signal output circuit 3 are designed to have an improved operation frequency in order to drive an LCD element having a number of horizontal pixels, their manufacturing costs become considerably high, resulting in a prominent cost increase of the driver.

SUMMARY OF THE INVENTION

It is therefore an object of the present invention to provide a low-cost full color liquid crystal driver capable of easily driving an LCD element that has a vast number of horizontal pixels.

A full color liquid crystal driver according to the present invention has a line memory circuit which receives a video signal, divides the video signal for each horizontal scan period into a plurality of groups (phases) of signals, expands the divided video signals of individual groups along the time axis in a horizontal scan period, and outputs the resultant signals. Each divided and expanded video signal is amplified by amplifier means to be a voltage necessary to drive an LCD element, and the amplified signal is output via a signal output circuit to the LCD element.

According to the present invention, the line memory circuit divides a video signal for each horizontal scan period into a plurality of groups, the amplifier means amplifies each divided video signal, and the signal output circuit outputs the amplified signal to the LCD element. It is therefore sufficient that the amplifier means and signal output circuit have an operation frequency corresponding to the divided video signal. This means that the amplifier means and the signal output circuit having slow operating speeds suffice, so that the LCD element having a large number of pixels can easily be driven by the amplifier means and signal output circuit which function at normal operating speeds.

DETAILED DESCRIPTION OF THE PREFERRED EMBODIMENTS

Preferred embodiments of the present invention will now be described referring to the accompanying drawings.

Figure 3:
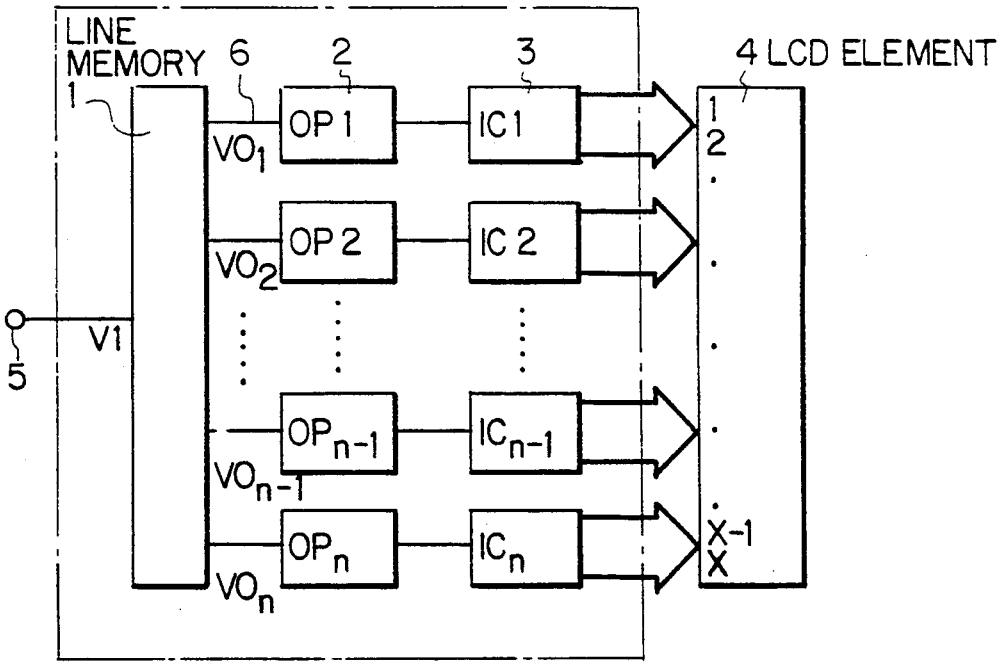
FIG. 3 is a block diagram of a full color liquid crystal driver according to a first embodiment of the present invention.

FIG. 3 presents a block diagram of a driver for a LCD element according to a first embodiment of the present invention. A line memory 1 which constitutes a LCD driver (enclosed by an alternate long and short dash line) is connected to a video signal input terminal 5, so that a video signal VI input to the video signal input terminal 5 is input to this line memory 1. The line memory 1 outputs n signals VO1, VO2, . . . , VOn onto line memory output signal lines 6 through which these signals are input to n amplifiers 2 (OP1, OP2, OP3, . . . , OPn-1, OPn). The output signals of the individual amplifiers 2 are respectively supplied to signal output circuits 3 (IC1, IC2, IC3, . . . , ICn-1, ICn). The output terminals of the individual signal output circuits 3 are connectable to (x/n) horizontal pixels in each group of x horizontal pixels of a liquid crystal display (LCD) element 4 divided by n.

In the thus constituted LCD driver, the video signal VI input via the video signal input terminal 5 to the line memory 1 is divided into n groups (phases) per horizontal scan period by the line memory 1. The divided video signals of n groups are expanded to n folds along the time axis. The line memory 1 then outputs the n expanded signals as divided video signals VO1 to VOn onto the output signal lines 6.

The divided and expanded signals of n groups output from the line memory 1 are amplified by the n respective amplifiers 2 to voltages necessary to drive the LCD element 4. Then, each amplified signal is divided into components equal in number to the individual pixels on one scan line by the associated signal output circuit 3 which has a sample/hold circuit and an output buffer in association with the individual pixels on one scan line. Each signal output circuit 3 outputs the divided signal components to the LCD element 4.

Figure 1:
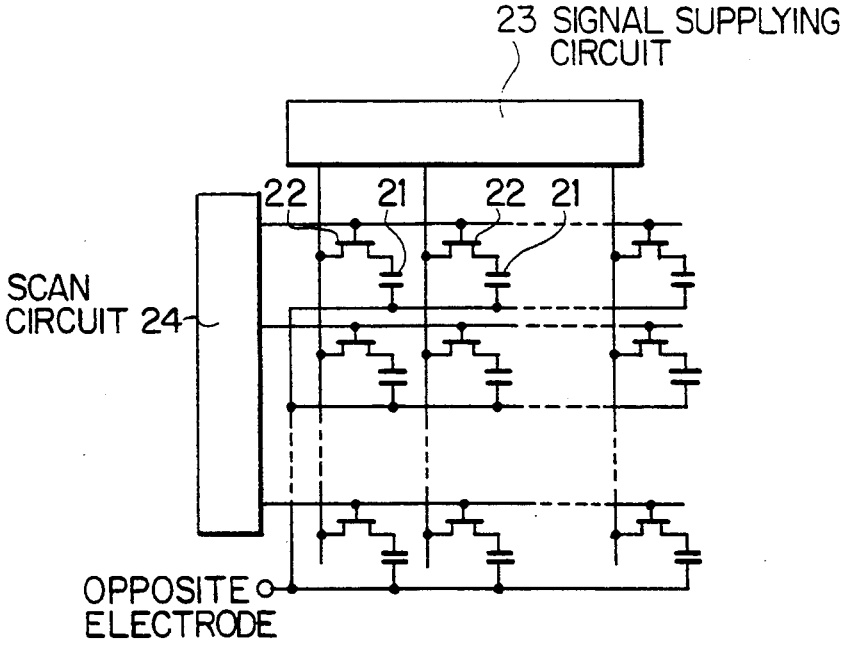
FIG. 1 PRIOR ART
FIG. 1 is an equivalent circuit diagram illustrating an active matrix type full color LCD.
Figure 2:
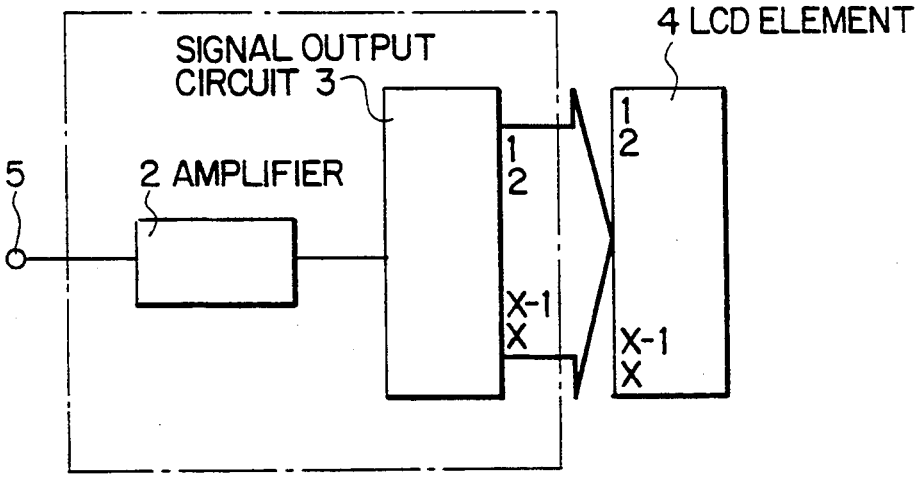
FIG. 2 PRIOR ART
FIG. 2 is a block diagram of a conventional LCD driver.

Given that the number of horizontal pixels of the LCD element 4 is x and the horizontal scan period is t, the necessary operation frequency for the amplifiers 2 and signal output circuits 3 becomes $1/(n(t/x))$, which is lower by 1/n than the operation frequency necessary for the amplifiers 2 and signal output circuits 3 of the conventional LCD driver shown in FIG. 1 in driving an LCD element having the same number (x) of horizontal pixels. A driver even for an LCD element having a large number (x) of horizontal pixels can therefore be accomplished using typical amplifiers and signal output circuits employed in the prior art. This feature can reduce the manufacturing cost of the driver.

A specific structure of the line memory 1 according to this embodiment will be described referring to FIGS. 4 and 5A through 5N.

Figure 4:
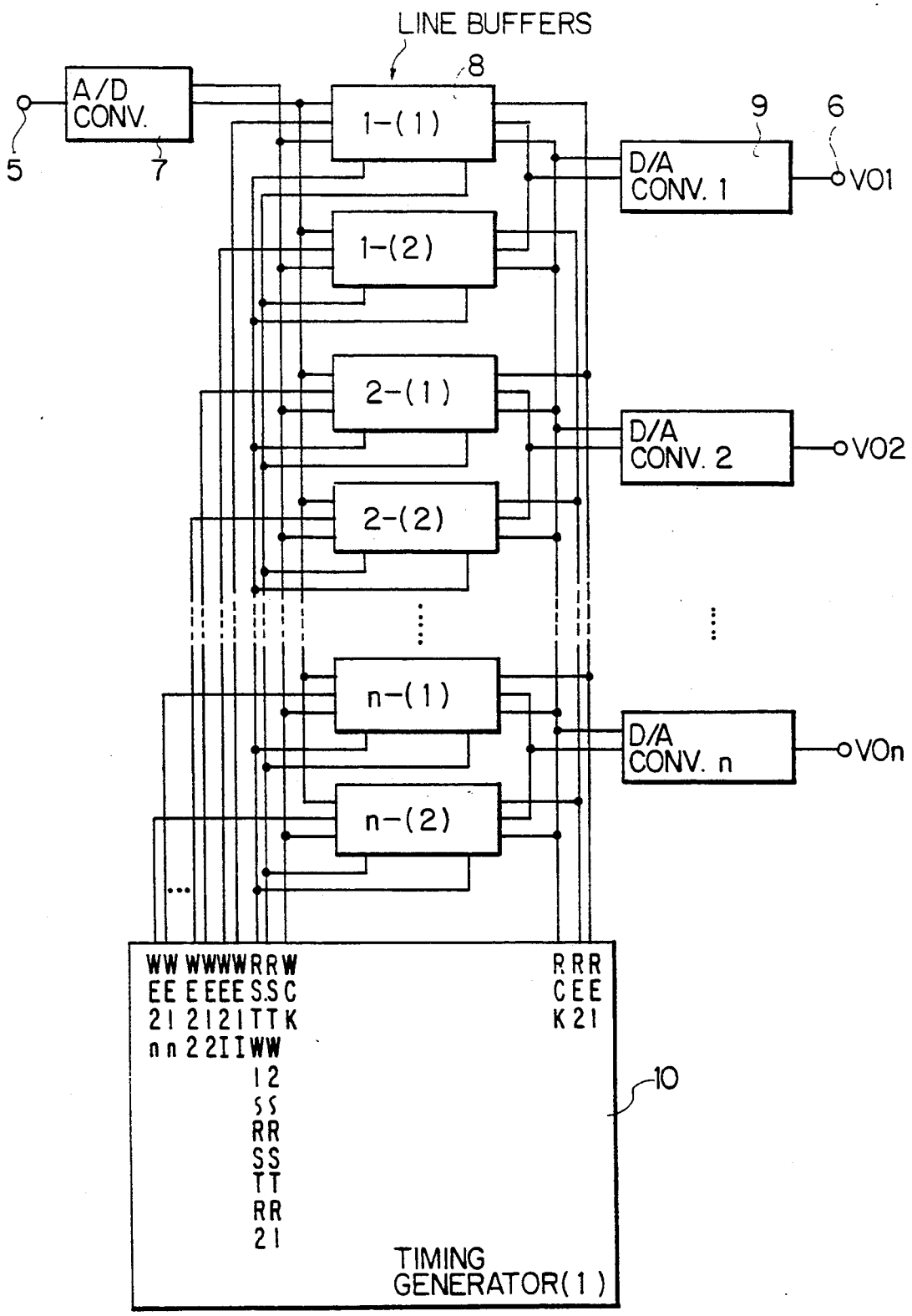
FIG. 4 is a detailed block diagram showing a line memory 1.
Figure 5:
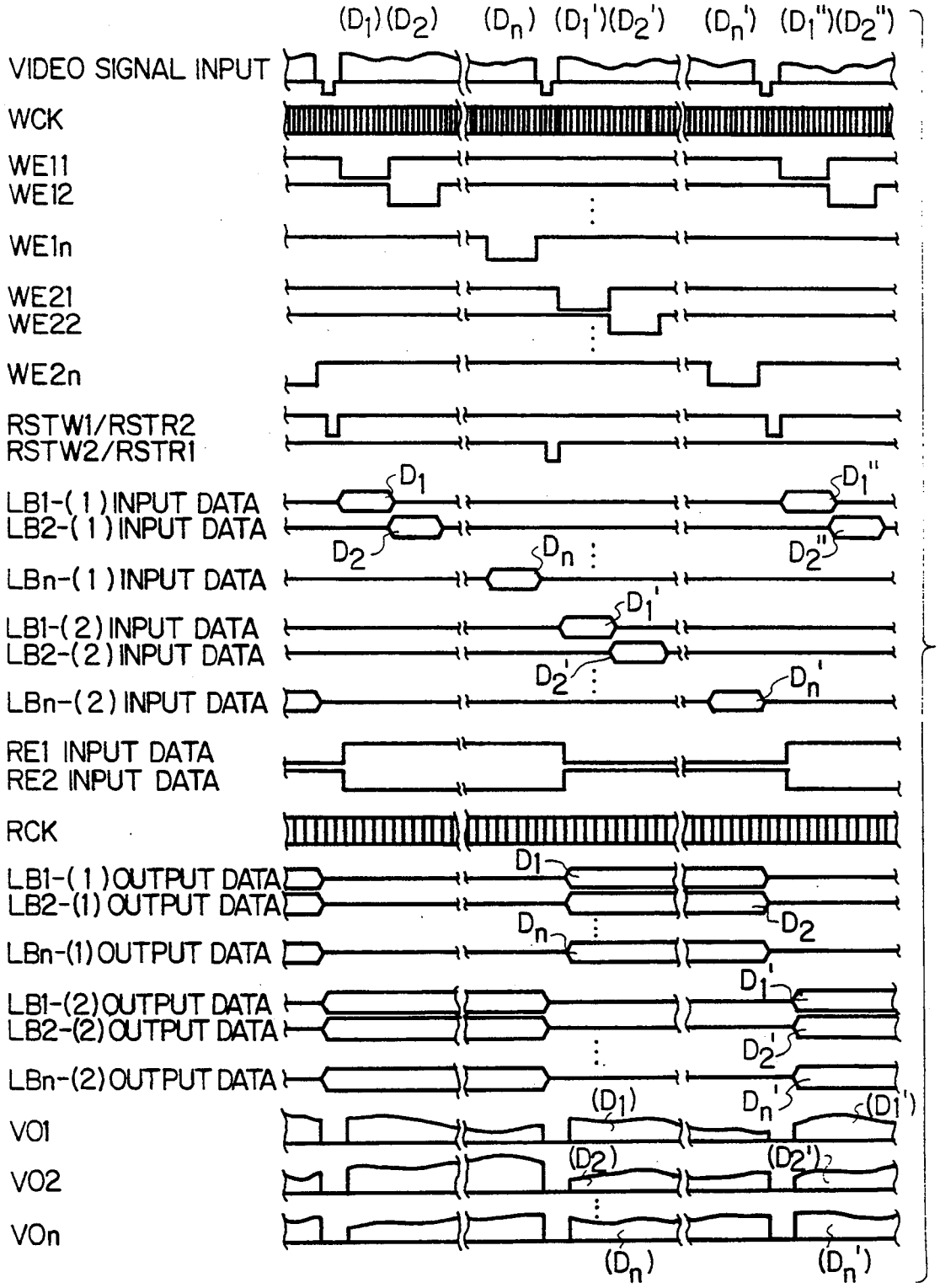
FIG. 5 is a timing chart for the line memory.

FIGS. 4 and 5 are respectively a block diagram of that portion of the line memory 1 in FIG. 3 which develops the video signal into n groups, and a timing chart for the portion. As shown in FIG. 4, the video signal input to the video signal input terminal 5 is input via an A/D converter 7 to a line buffer 8. This line buffer 8 comprises n sets of line buffer circuits 1-(1), 1-(2), 2-(1), 2-(2), . . . , n-(1), n-(2), each set consisting of two line buffer circuits. This line buffer 8 can hold data for one horizontal period while the video signal is converted into a digital signal.

A timing generator (1) 10 has an oscillator, a counter, a decoder and a phase comparator. This timing generator 10 outputs a write sampling clock signal WCK to the A/D converter 7 and each line buffer 8, and outputs a read clock RCK to each line buffer 8. The former clock signal WCK has a sufficient frequency not to impair the image quality when the video signal undergoes A/D conversion. The timing generator 10 also generates signals WE1n, WE2n, . . . , RE1, RE2, etc. necessary for digital signal processing synchronous with the video signal. The outputs of the individual line buffers 8 are input to n D/A converters 9 whose output signals are sent onto the respective line memory output signal lines 6.

The operation of the line memory 1 with the above structure will be described below. The signal coming from the video signal input terminal 5 is input to the A/D converter 7 to be converted into a digital signal at the timing of the signal WCK. After the write addresses of the line buffers 8 are reset by a write address reset signal RSTW1, the output signal of the A/D converter 7 is input to the line buffers 8 (1-(1), 2-(1), . . . , n-(1)) when the write control signals WE11, WE12, . . . , WE1n are at a low level.

After the read addresses of the line buffers 8 are reset by a read address reset signal RSTR1, the signals held in the individual line buffers 8 are read out in response to the read clock RCK having a frequency, 1/n of that of the signal WCK, when the read control signal RE1 is at a low level. While pieces of data are read out from the line buffers 8 (1-(1), 2-(1), . . . , n-(1)) the line buffers 8 (1-(2), 2-(2), . . . , n-(2)) are reset by a write address reset signal RSTW2, and the digital video signals are input to the latter line buffers when the write control signals WE21, WE22, . . . , WE2n are at a low level.

Then, the read addresses of the line buffers 8 are reset by a read address reset signal RSTR2, and pieces of data are read out from the line buffers 8 at the timing of the signal RCK when the read control signal RE2 becomes a low level. The data read out from each line buffer 8 is converted by the associated D/A converter 9 (1, 2, . . . , n) into an analog signal, which is in turn output onto the associated output signal line 6.

The above operation will now be specifically described with reference to the case where video signals D1 to Dn are supplied in a certain horizontal scan period, as shown in FIG. 5A.

At the beginning of one horizontal scan period, as shown in FIG. 5E, the write address reset signal RSTW1 is supplied to the line buffers 1-(1) to n-(1) to reset their write addresses and the read address reset signal RSTR2 is supplied to the line buffers 1-(2) to n-(2) to reset their read addresses.

Then, the supplied video signals are converted into digital signals D1 to Dn in response to the clock signal WCK as shown in FIG. 5B. As shown in FIG. 5C, the write control signals WE11 to WE1n sequentially become an active level (low level in FIG. 5C), setting the line buffers 1-(1) to n-(1) in a write enable state in order. Consequently, the digital video signals D1 to Dn are sequentially written in the respective line buffers 1-(1) to n-(1), as shown in FIG. 5G.

In the meantime, the line buffers 1-(2) to n-(2) are supplied with the read signal RE2 (see FIG. 5J) of an active level (low level in FIG. 5J), and sequentially output the stored video signals as shown in FIG. 5M in response to the clock RCK shown in FIG. 5K. The video signals output from the line buffers 1-(2) to n-(2) are converted by the D/A converters 9 into analog signals (see FIG. 5N), which are in turn output onto the output signal lines 6.

At the beginning of the next horizontal scan period, as shown in FIG. 5F, the read address reset signal RSTR1 is supplied to the line buffers 1-(1) to n-(1) to reset their read addresses and the write address reset signal RSTW2 is supplied to the line buffers 1-(2) to n-(2) to reset their write addresses Then, the supplied video signals shown in FIG. 5A are converted into digital signals D1′ to Dn′ in response to the clock signal WCK as shown in FIG. 5B. As shown in FIG. 5D, the write control signals WE21 to WE2n sequentially become an active level, setting the line buffers 1-(2) to n-(2) in a write enable state in order. Subsequently, the digital video signals D1′ to Dn′ are written in the respective line buffers 1-(2) to n-(2), as shown in FIG. 5H.

The line buffers 1-(1) to n-(1) are supplied with the read signal RE1 (see FIG. 5I) of an active level, and sequentially output the video signals D1 to Dn (see FIG. 5L), stored in the previous horizontal scan period, in response to the clock RCK. The video signals output from the line buffers 1-(1) to n-(1) are converted by the D/A converters 9 into analog signals (see FIG. 5N), which are in turn output onto the output signal lines 6.

Figure 6:
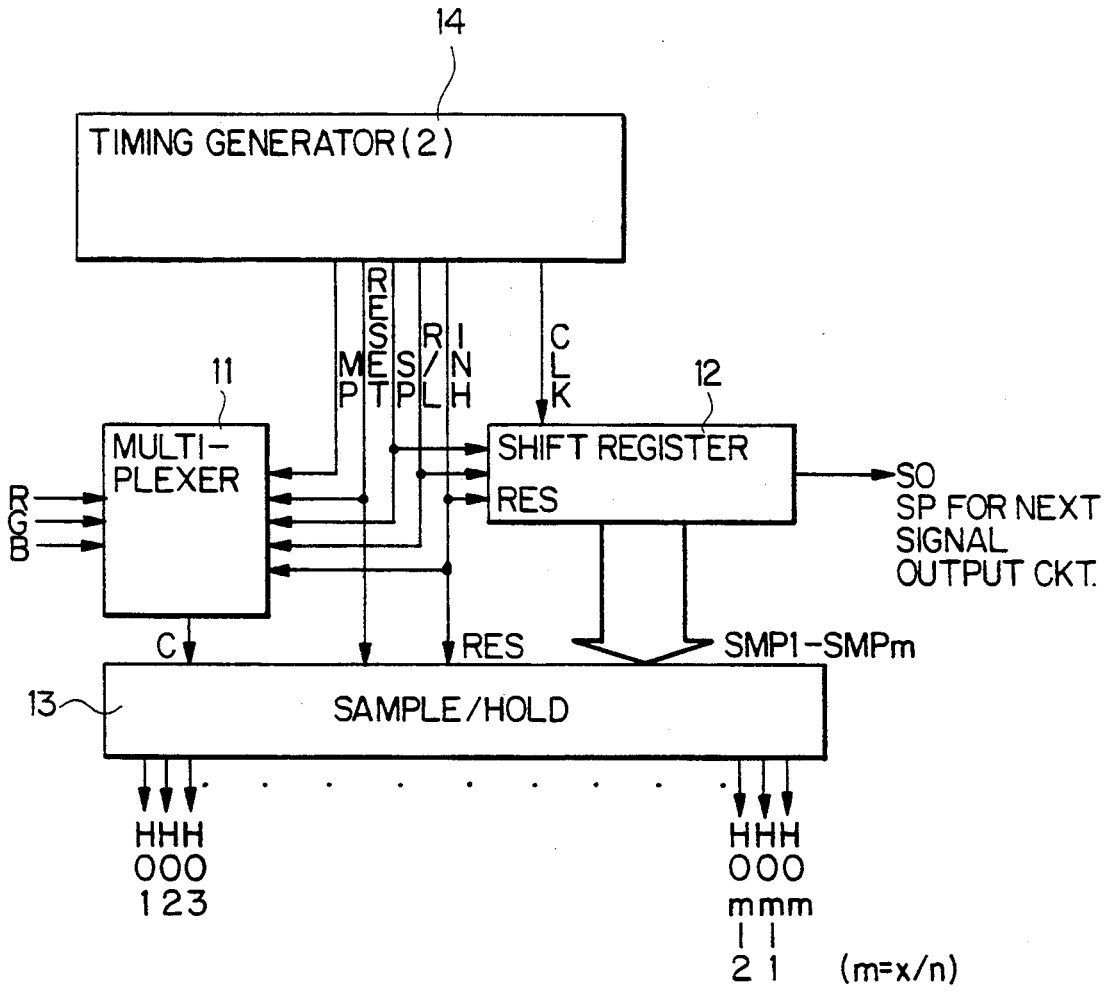
FIG. 6 is a detailed block diagram showing a signal output circuit 3.

Thereafter, the same operation will be repeated. FIGS. 6 and 7A through 7L respectively present a block diagram illustrating a specific structure of each of the signal output circuits IC1 to ICn, and a timing chart for that signal output circuit. A timing generator (2) 14 shown in FIG. 6 comprises an oscillator, a counter, a decoder and a phase comparator (none of them shown). This timing generator 14 outputs a shift clock having a frequency of 1/(n(t/x)) for a shift register 12, and generates controls signals for a multiplexer 11, the shift register 12 and a sample/hold circuit 13 in synchronism with the video signals. The multiplexer 11 selectively switches the input video signals R, G and B in accordance with the pixel arrangement of the LCD element, which is selected by an MP signal, and the shift direction of the shift register 12, which is specified by an R/L signal. The multiplexer 11 then outputs a video signal C, which is the selected video signal R, G or B. The multiplexer 11 resets a built-in counter for every vertical period in response to a RESET signal and for every horizontal period in response to an INH signal, and starts the switching operation upon reception of an SP signal.

When the shift register 12 receives the SP signal after its built-in counter is reset by the INH signal, the shift register 12 sequentially outputs sampling pulses SMP1 to SMPm in accordance with the shift direction specified by the R/L signal in synchronism with a CLK signal. After outputting the m-th sampling pulse, the shift register 12 outputs a signal SO for the SP signal of the next signal output circuit. The sample/hold circuit 13 has outputs HO1 to HOm, and is provided with two sample/hold capacitors for each output. When the sampling pulses SMP1 to SMPm from the shift register 12 are at a high level, the voltage value of the video signal C output from the multiplexer 11 is held in each capacitor of the sample/hold circuit 13, the held voltage is output therefrom while the next INH signal is at a low level, and the held voltage is reset during the next high-level duration of the INH signal. The sample/hold circuit 13 continuously outputs signals by switching the capacitors to hold and output the voltage for every horizontal period.

Figure 7:
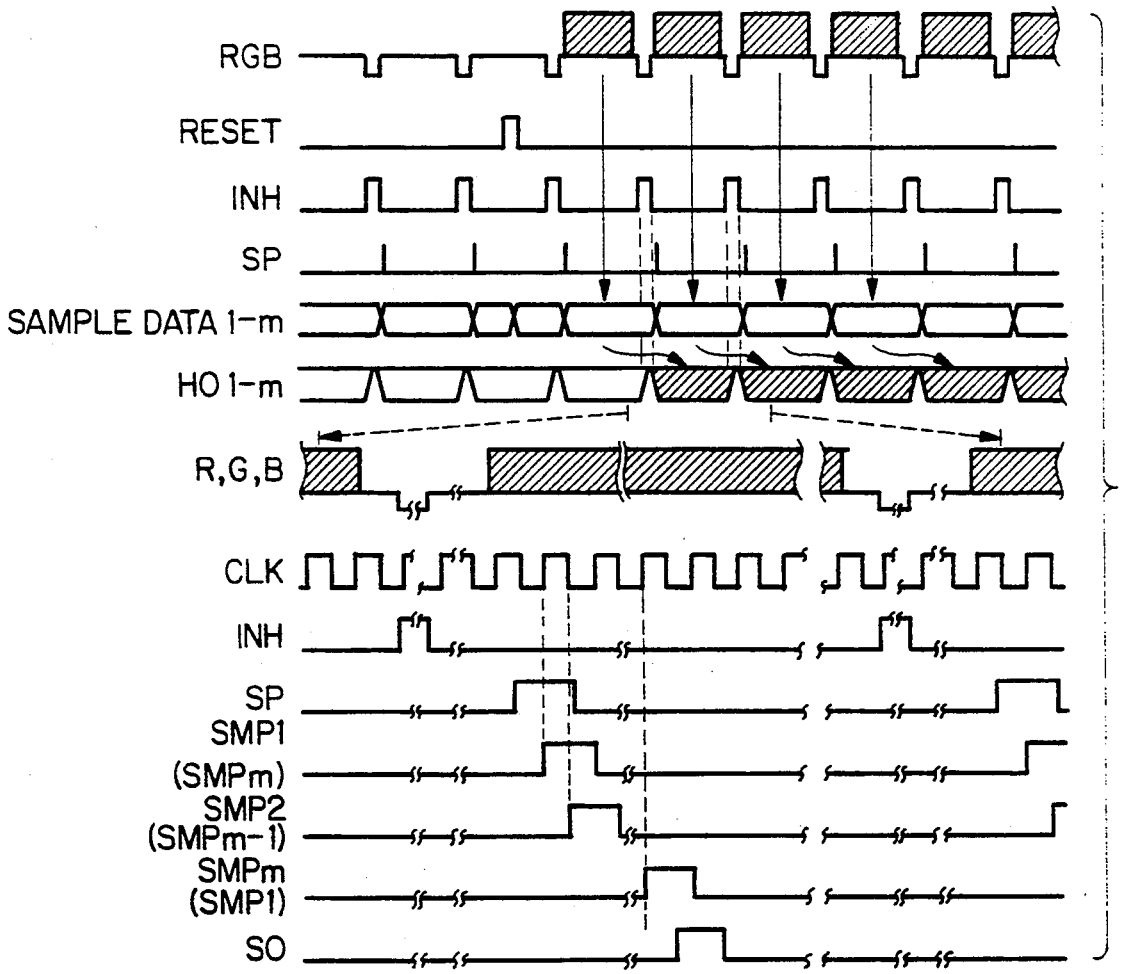
FIG. 7 is a timing chart for the signal output circuit.

The operation of the thus constituted signal output circuit will now be described referring to FIGS. 7A through 7L. At the beginning of a vertical scan period, as shown in FIG. 7B, the RESET signal is supplied to the multiplexer 11 and the sample/hold circuit 13 to reset their built-in timers, etc. Then, at the beginning of each horizontal scan period, as shown in FIG. 7C, the INH signal is supplied to the multiplexer 11, shift register 12 and sample/hold circuit 13 to reset their built-in timers. The SP signal is supplied immediately after the supply of the RGB video signals starts in each horizontal scan period, as shown in FIG. 7D. In response to this SP signal, the multiplexer 11 sequentially selects the received RGB video signals and sends the selected video signals to the sample/hold circuit 13, as shown in FIG. 7E. The sample/hold circuit 13 sequentially samples the received video signals C and outputs the sampled signals at the bitting of the next horizontal scan period or in response to the next INH signal, as shown in FIG. 7F.

The operations of the individual sections of the signal output circuit will be described below referring to FIGS. 7G through 7L. The INH signal is output at the beginning of a horizontal scan period as shown in FIG. 7I, and then the SP signal is output at approximately the same time as the RGB video signals are supplied, as shown in FIG. 7J. Thereafter, the multiplexer 11 sequentially selects and outputs the RGB video signals in response to the internal clock CLK shown in FIG. 7H. The shift register 12 sequentially outputs the sampling pulses SMP1 to SMPm (SMPm to SMP1 depending on the level of the R/L signal), as shown in FIG. 7K. In response to the sampling pulses SMP1 to SMPm, the sample/hold circuit 13 samples and holds the supplied data in order from the HO1 side. Finally, the shift register 12 outputs the signal SO as shown in FIG. 7L.

As described above, according to this embodiment, after the line memory 1 divides a video signal in each horizontal scan period into a plurality of groups or phases and then expands the signals of the individual groups in the horizontal scan period, the multiple amplifiers 2 and multiple signal output circuits 3 prepare and output drive signals to the LCD element 4, thus allowing for the use of amplifiers and signal output circuits which have a low operation frequency. The driver according to this embodiment can therefore easily drive a LCD element having a vast amount of horizontal pixels.

According to the conventional liquid crystal driver, to provide full color display (analog display) when the number of horizontal pixels is increased, the frequency response of the analog amplifier should also be improved. This embodiment can however allow a clear image to be displayed without improving the frequency response of the amplifier.

Figure 8:
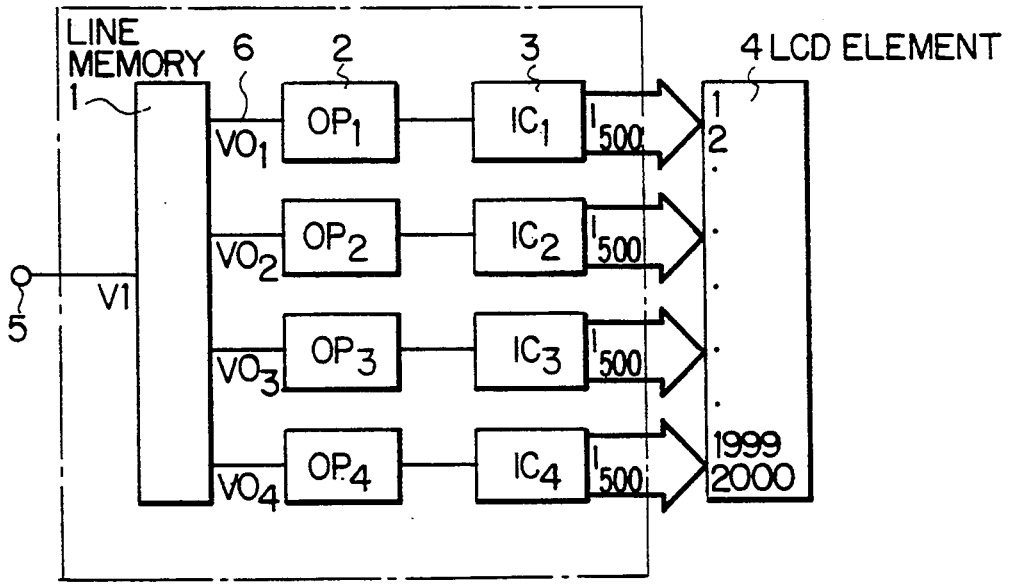
FIG. 8 is a block diagram of a full color liquid crystal driver according to a second embodiment of the present invention.
Figure 9:
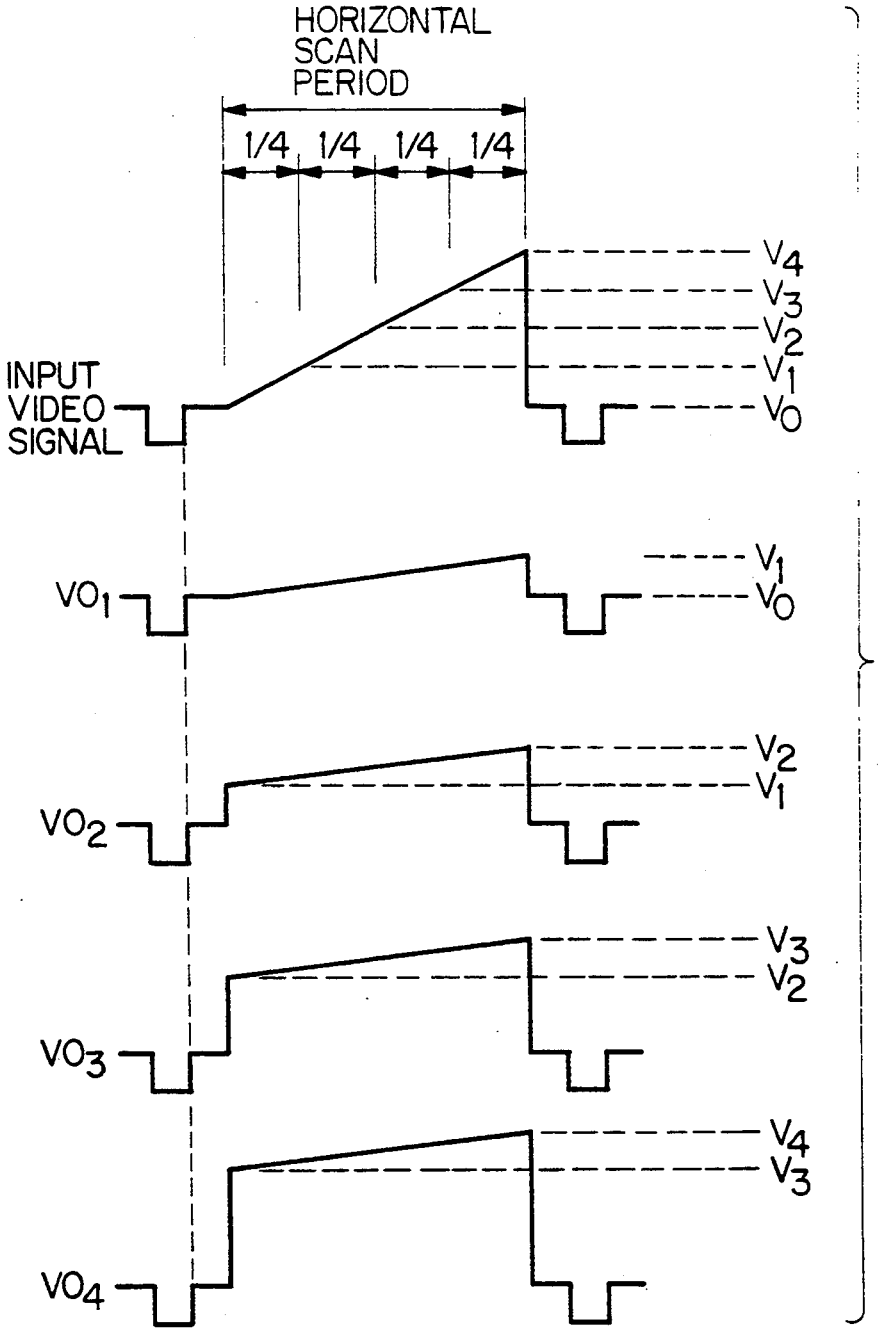
FIG. 9 is a waveform diagram showing an input signal and signals output from a line memory in the second embodiment.

Referring now to FIG. 8 and FIG. 9 presenting a signal waveform diagram, a description will now be given of an embodiment in the case where a video signal is divided into four groups. The line memory 1 divides the input video signal into four groups or phases, and expands the video signals of the individual groups to four folds before output them onto the line memory output signal lines 6. The line memory output signals are input to four amplifiers 2 where the signals are amplified to be voltages necessary to drive a LCD element. The amplified signals are input to the signal output circuits 3. The signal input to each signal output circuit 3 is divided into 500 ($=2000\times\frac{1}{4}$) signals, which are in turn output to the LCD element that has horizontal pixels with 2000 values. In this case, with each horizontal scan period set to 50 microseconds, the operation frequency the amplifiers 2 and signal output circuits 3 need is 10 MHz. When the convention driver is used under the same condition, the required operation frequency of the amplifiers and signal output circuits is 40 MHz.

What is claimed is:

1. A liquid crystal driver for driving a liquid crystal display element, comprising:

a line memory circuit receiving a video signal, dividing said video signal for each horizontal scan period into a plurality of groups and outputting in parallel a plurality of video data corresponding respectively to said groups; and a drive circuit coupled between said line memory circuit and said liquid crystal display element for driving said liquid crystal display element in response to said video data output from said line memory circuit;

said line memory circuit comprising:

a plurality of first line buffers corresponding in number to said groups, each of said first line buffers including a first video input supplied with video data corresponding to said video signal, a first write control terminal and a first read control terminal, each of said first line buffers entering a data write mode to store the video data supplied to said first video input terminal when an associated one of first write-enable signals is supplied to said first write control terminal, and wherein each of said first line buffers enters a date read mode to read out said video data stored therein when a first read-enable signal is supplied to said first read control terminal;

a plurality of second line buffers corresponding in number to said groups, each of said second line buffers including a second video input terminal supplied with said video data corresponding to said video signal, a second write control terminal and a second read control terminal, each of said second line buffers entering a data write mode to store said video data when an associated one of second write-enable signals is supplied to said second write control terminal, and wherein each of said second line buffers enters a data read mode to read out said video data stored therein when a second read-enable signal is supplied to said second read control terminal; and a timing generator for generating and supplying said first write-enable signals in sequence to the first write control terminal of said first line buffers, respectively, while generating and supplying said second read-enable signal in common to the second read control terminals of said second line buffers, said timing generator further generating and supplying said second write-enable signals in sequence to second write control terminals of said second line buffers, respectively, while generating and supplying said first read-enable signal in common to the first read control terminals of said first line buffers, wherein said first line buffers and said second line buffers enter in sequence said data write mode to store video data representing a video signal corresponding to a current horizontal scan period so that when one of said first and second line buffers enters said data write mode, the other one of said first and second line buffers enters said data read mode to read video data representing a video signal corresponding to a previous horizontal scan line.

2. The driver as claimed in claim 1, wherein said timing generator further generates and supplies a write clock signal of a first frequency and a read clock signal of a second frequency to each of said first and second line buffers, each of said first and second line buffers storing said video data a plurality of times in response to a plurality of clocks of said write clock signal supplied during said data write mode and reading out said video data stored therein a plurality of times in response to clocks of said read clock signal supplied during said data read mode.

3. The driver as claimed in claim 2, wherein said line memory circuit further comprises an A/D converter for converting said video signal into digital video data and a plurality of D/A converters each for converting the video data output from an associated one of said first and second line buffers which is entering said data read mode into an analog video signal.

* * * * *